US008749945B2

(12) United States Patent
Burrows et al.

(10) Patent No.: US 8,749,945 B2
(45) Date of Patent: Jun. 10, 2014

(54) ELECTRICAL ARRANGEMENT OF HYBRID IGNITION DEVICE

(75) Inventors: John Antony Burrows, Northwich (GB); James D. Lykowski, Temperance, MI (US)

(73) Assignee: Federal-Mogul Ignition, Southfield, MI (US)

( * ) Notice: Subject to any disclaimer, the term of this patent is extended or adjusted under 35 U.S.C. 154(b) by 174 days.

(21) Appl. No.: 13/222,616

(22) Filed: Aug. 31, 2011

(65) Prior Publication Data

US 2012/0063054 A1 Mar. 15, 2012

Related U.S. Application Data

(60) Provisional application No. 61/378,673, filed on Aug. 31, 2010.

(51) Int. Cl.

| | |
|---|---|
| ***F23Q 3/00*** | (2006.01) |
| ***G03G 15/02*** | (2006.01) |
| ***F02P 3/05*** | (2006.01) |

(52) U.S. Cl.

USPC ..... 361/256; 361/233; 361/235; 123/623

(58) Field of Classification Search

USPC ..... 361/256, 233, 235; 123/623

See application file for complete search history.

(56) References Cited

U.S. PATENT DOCUMENTS

| | | | |
|---|---|---|---|
| 3,974,412 | A | 8/1976 | Pratt, Jr. |
| 4,369,758 | A | 1/1983 | Endo |
| 5,471,362 | A | 11/1995 | Gowan |
| 5,568,801 | A | 10/1996 | Paterson et al. |
| 5,654,868 | A | 8/1997 | Buer |
| 5,727,534 | A | 3/1998 | Kondo et al. |
| 5,777,216 | A | 7/1998 | Van Duyne et al. |

(Continued)

FOREIGN PATENT DOCUMENTS

| | | | |
|---|---|---|---|
| EP | 2187044 | A1 | 5/2010 |
| EP | 2199597 | A2 | 6/2010 |
| WO | 2004047146 | A2 | 6/2004 |
| WO | 2010011838 | A1 | 1/2010 |

OTHER PUBLICATIONS

International Search Report PCT/US2011/049924 mailed on Mar. 28, 2012.

*Primary Examiner* — Scott Bauer

(74) *Attorney, Agent, or Firm* — Robert L. Stearns; Dickinson Wright, PLLC

(57) ABSTRACT

A corona ignition system 20 includes a corona drive circuit 26 and an auxiliary energy circuit 28. The energy circuit 28 stores energy during a standard corona ignition cycle. When arc discharge occurs or corona discharge switches to an arc discharge, the energy circuit 28 discharges the stored energy to the electrode 30 to intentionally maintain a robust arc discharge 29 and thus provide reliable ignition. The stored energy is transmitted to the electrode 30 over a predetermined period of time. The arc discharge is detected and an arc control signal 60 is transmitted to the energy circuit 28, triggering discharge of the stored energy to the electrode 30. The stored energy can be transmitted to the electrode 30 along a variety of different paths. The voltage of the stored energy is typically increased by an energy transformer 70 before being transmitted to the electrode 30.

20 Claims, 4 Drawing Sheets

(56) References Cited

U.S. PATENT DOCUMENTS

| | | | | |
|---|---|---|---|---|
| 6,553,981 | B1 | 4/2003 | Suckewer et al. | |
| 6,883,507 | B2 | 4/2005 | Freen | |
| 7,095,181 | B2 | 8/2006 | Frus et al. | |
| 7,323,213 | B2 * | 1/2008 | Inoue et al. | 427/8 |
| 7,594,958 | B2 | 9/2009 | Krichtafovitch et al. | |
| 2006/0165429 | A1 * | 7/2006 | Satoh et al. | 399/69 |
| 2010/0147239 | A1 | 6/2010 | Lu et al. | |
| 2011/0197865 | A1 * | 8/2011 | Hampton | 123/623 |

* cited by examiner

ELECTRICAL ARRANGEMENT OF HYBRID IGNITION DEVICE

CROSS REFERENCE TO RELATED APPLICATION

This application claims the benefit of application Ser. No. 61/378,673 filed Aug. 31, 2010.

BACKGROUND OF THE INVENTION

1. Field of the Invention

This invention relates generally to a corona ignition system and method for igniting a mixture of fuel and air of a combustion chamber.

2. Description of the Prior Art

Corona ignition systems are often preferred for providing robust ignition without the high temperatures and related consequences of conventional spark ignition systems. The corona ignition system includes an igniter having an electrode extending into a combustion chamber. The ground is provided by walls of the combustion chamber or a piston reciprocating in the combustion chamber. The igniter does not include a ground electrode. The electrode of the igniter receives energy from an energy supply and emits an electrical discharge, preferably in the form of a corona discharge. A corona discharge is an electrical field including a plurality of ionized streamers having high electrical impedance from the electrode to the ground. When fuel is supplied to the combustion chamber, the electrical field ignites the mixture of fuel and air in the combustion chamber. An example of a corona ignition system is disclosed in U.S. Pat. No. 6,883,507 to Freen.

As energy is supplied the electrode, the concentration of ions in the electrical field increases. A high voltage is preferred to provide a robust corona discharge. However, if the voltages increases beyond a certain threshold, the increasing ion concentration results in a cascading process typically causing the corona discharge to transform into an arc discharge. An arc discharge is an electrical field including a single streamer providing a conductive path from the electrode to the ground. In typically corona ignition systems, when arc discharge occurs, all of the stored energy of the system is immediately discharged and depleted. The arc discharge may be of short duration and thus not capable of providing reliable ignition. Accordingly, the energy level provided to the electrode is typically at the highest voltage that can provide a corona discharge without switching to an arc discharge.

Oftentimes the voltage passes the corona discharge threshold and the arc discharge occurs. In addition, other situations or engine conditions can cause arc discharge. The arc discharge may also occur when the igniter is fouled by fuel of carbon deposits, or when the piston is too close to the igniter, or during other situations where there is low electrical resistance between the electrode and ground. The arc discharge is typically unintentionally formed and undesirable, but there are certain situations where arc discharge is intentionally formed. In attempt to stop the arc discharge and restore corona discharge, when arc discharge is undesirable, the voltage supplied to the electrode is immediately decreased. However, reducing the voltage is oftentimes not practical or not effective in returning to corona discharge and providing reliable ignition.

SUMMARY OF THE INVENTION

One aspect of the invention provides a corona ignition system for igniting a mixture of fuel and air of a combustion chamber. The system includes an electrode, a corona drive circuit, and an energy storage circuit. The corona drive circuit transmits energy to the electrode in an amount capable of emitting an electrical discharge from the electrode. The energy circuit is auxiliary to the corona drive circuit and stores energy while the corona drive circuit transmits the energy to the electrode. Upon detection of arc discharge, the energy circuit transmits the stored energy to the electrode to intentionally maintain the arc discharge.

Another aspect of the invention provides a method for igniting a mixture of fuel and air of a combustion chamber. The method comprises the steps of: transmitting energy from a corona drive circuit to an electrode in an amount capable of emitting an electrical discharge from the electrode, and storing energy in an energy circuit auxiliary to the corona drive circuit while providing energy to the electrode. The method further includes detecting an arc discharge, and intentionally maintaining an arc discharge upon detecting the arc discharge. The step of intentionally maintaining arc discharge includes transmitting the stored energy from the energy circuit to the electrode.

Instead of decreasing the energy provided to the electrode at the onset of arc discharge, as in systems of the prior art, the system and method of the present invention includes providing energy stored in an auxiliary energy circuit to the electrode to intentionally maintain the arc discharge and ensure a robust and reliable ignition.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
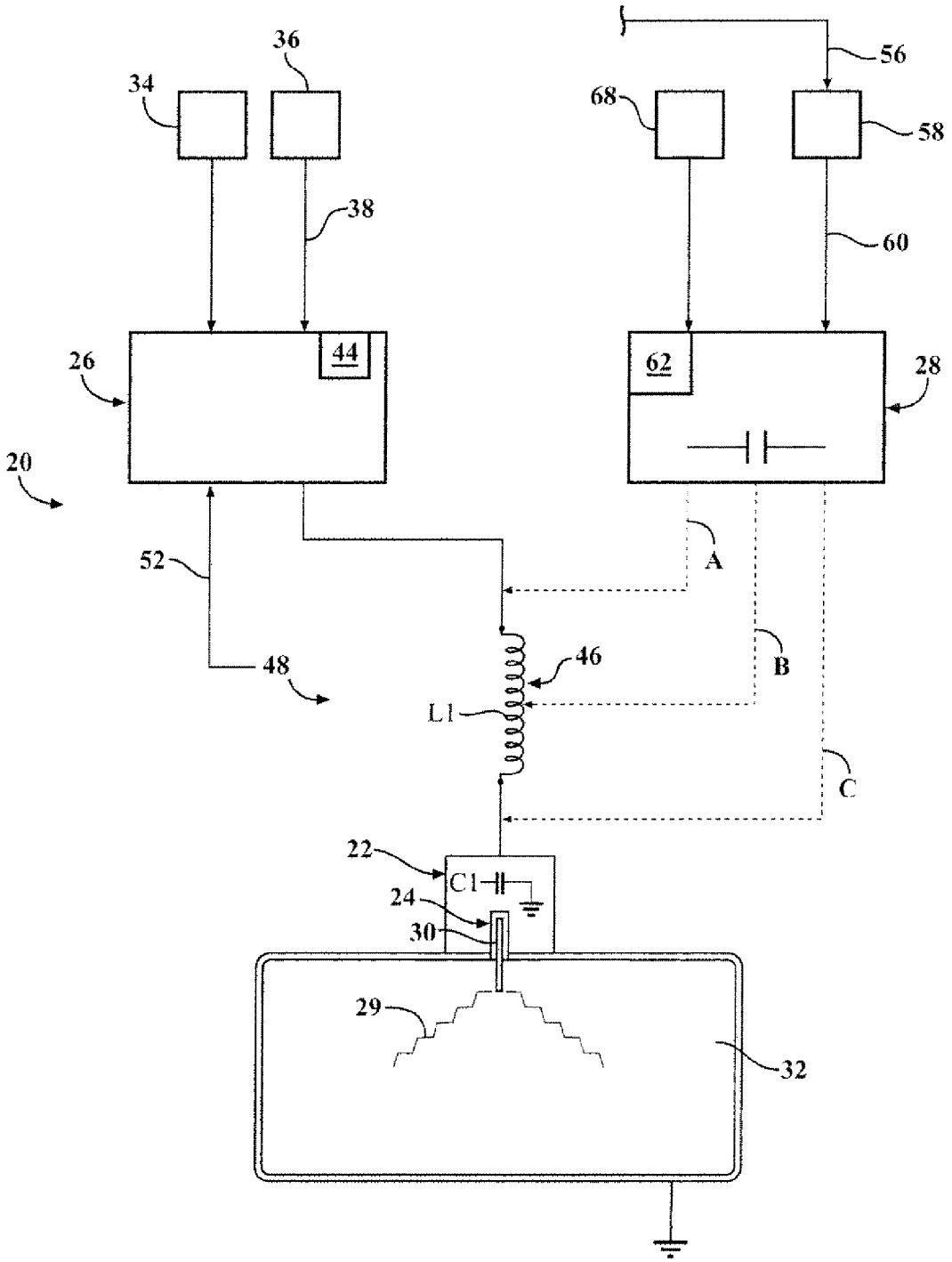
FIG. 1 is a diagram of the corona ignition system according to one embodiment of the invention showing alternate energy delivery paths A, B, and C.

One aspect of the invention provides a corona ignition system 20 for igniting a mixture of fuel and air of a combustion chamber 32 comprising a firing end assembly 22, a corona drive circuit 26, and an energy storage and delivery circuit, referred to as an energy circuit 28. The firing end assembly 22 comprises an igniter 24 including an electrode 30 projecting into a combustion chamber 32. The corona drive circuit 26 transmits energy to the electrode 30 in an amount capable of emitting an electrical discharge, typically corona discharge but maybe arc discharge, from the electrode 30. The energy circuit 28 is auxiliary to the corona drive circuit 26 and stores supplemental energy while the corona drive circuit 26 transmits energy to the electrode 30. When arc discharge is detected, the energy circuit 28 then transmits the stored energy to the electrode 30 to intentionally maintain the arc discharge 29. The stored energy transmitted to the electrode 30 provides a robust arc discharge 29, which accordingly provides reliable ignition.

The igniter 24 of the firing end assembly 22 is installed in a cylinder head of the engine (not shown), typically an internal combustion engine of an automotive vehicle, such as a hybrid vehicle, or a gas turbine engine. The electrode 30 of the igniter 24 typically includes a firing tip for emitting the electrical field. As shown in FIG. 1, the system 20 includes a drive power supply 34 providing the energy to the corona drive circuit 26 and ultimately to the electrode 30. In an automotive vehicle, the drive power supply 34 is typically a 12 volt battery, but can be another power source.

The corona ignition system 20 is designed to provide energy to the electrode 30 at a predetermined time, duration, and voltage level such that the electrode 30 emits the electrical field, typically in the form of a corona discharge, and ignition occurs along the entire length of the electrical field. The predetermined time, duration and voltage level may be calculated or determined by an engine control unit (ECU) of the vehicle. The voltage level is typically the highest voltage capable of providing a corona discharge without forming an arc discharge. The system 20 includes a drive circuit controller 36 providing a drive control signal 38 to the corona drive circuit 26, indicating the predetermined time, duration, and voltage level required to achieve corona discharge. The drive circuit controller 36 can be integral with the ECU, or can be a separate unit.

Upon receiving the energy from the drive power supply 34, and receiving the drive control signal 38 from the drive circuit controller 36, the corona drive circuit 26 manipulates the energy to output an AC current and to meet the predetermined time, duration, and voltage level required to achieve the corona discharge. The corona drive circuit 26 also manipulates the energy to match a particular resonance frequency, which will be discussed further below. The corona drive circuit 26 is a high frequency oscillating circuit which may also include a transformer, referred to as a drive transformer 44. The circuit 26 is used to manipulate the energy provided by the drive power supply 34.

The corona drive circuit 26 then transmits the manipulated AC current of energy to a tuned or LC circuit 48, as shown in FIG. 1. The LC circuit is also referred to as an LC resonant circuit or LC resonator. The LC circuit is provided by a resonating inductor 46 and capacitance (C1) of the firing end assembly 22, as shown in FIG. 1. The resonating inductor 46 operates at a particular voltage (L1) and is provided by a coil of metal, such as copper. The coil is referred to as the first coil 50, and is coupled to the electrode 30 of the igniter 24. The resonating inductor 46 also operates at a resonance frequency. As alluded to above, a feedback loop signal 52 from the LC circuit 48 to the corona drive circuit 26 conveys the resonance frequency to the corona drive circuit 26, and the corona drive circuit 26 manipulates the supplied energy to match the resonating frequency. The system 20 can also include electrical connection and insulation components between the resonating inductor 46 and electrode 30.

Upon receiving the energy from the corona drive circuit 26, the LC circuit 48 transforms the energy prior to transmitting it to the electrode 30. The LC circuit 48 typically amplifies the voltage and decreases the current. In one embodiment, the LC circuit 48 increases the energy to a voltage of up to 15,000 volts, typically 5,000 to 10,000 volts. The energy is then transmitted from the LC circuit 48 to the electrode 30 to provide the corona discharge.

As stated above, when the electrode 30 of the igniter 24 receives the energy from the LC circuit 48, the resonance causes a high voltage at the electrode 30, and the electrode 30 emits the electrical field in the surrounding air of the combustion chamber 32, preferably in the form of corona discharge, but possibly in the form of arc discharge. The predetermined voltage level provided to the electrode 30 is typically the highest voltage that can provide a corona discharge without switching to an arc discharge. When fuel is supplied to the combustion chamber 32, the electrical field ignites the mixture of fuel and air in the combustion chamber 32 along the entire length of the electrical field. If the electrode is emitting the corona discharge and providing reliable ignition, the corona ignition system 20 may operate without employing the stored energy from the energy circuit 28.

However, to ensure reliable ignition in the event arc discharge occurs, or if corona discharge switches to arc discharge, supplemental energy is stored in the energy circuit 28 auxiliary to the corona drive circuit 26 at startup and simultaneously while the system 20 operates. In the event of arc discharge, or if the corona discharge switches to arc discharge, the energy of the corona drive circuit 26 is immediately depleted. The arc discharge immediately causes the small amount of energy stored in the LC resonator 48 to discharge. Typically, the arc discharge remains for a short period of time, but not long enough to ensure reliable ignition.

Thus, to ensure reliable ignition upon the occurrence of the arc discharge, the energy stored in the energy circuit 28 is immediately discharged into the system 20 and ultimately transmitted to the electrode 30 to intentionally maintain the arc discharge 29. The stored energy is transmitted to the electrode 30 in an amount great enough to maintain the arc discharge 29 at a robust level and duration, and the intentionally maintained arc discharge 29 ignites the mixture of fuel and air in the combustion chamber 32.

As stated above, various conditions can trigger the onset of the arc discharge, but the arc discharge typically occurs when the voltage provided to the electrode 30 surpasses a certain threshold. Any method known in the art can be used to detect the onset or presence of arc discharge. Upon detecting the arc discharge, an arc feedback signal 56 is transmitted to a controller of the energy circuit 28, referred to as an energy controller 58. The energy controller 58 receives the arc feedback signal 56, then transmits an arc control signal 60 to the energy circuit 28, initiating and instructing the energy circuit 28 to discharge the stored energy for transmission to the electrode 30. The energy controller 58 can be integrated with the ECU or the drive circuit controller 36, or can be a separate unit.

The energy circuit 28 typically includes a capacitor, referred to as the energy capacitor 62, for storing the additional energy. The energy capacitor 62 stores energy in an amount much greater than the amount stored by the LC resonant circuit 48 or other capacitors typical used corona ignition systems 20, typically 100 to 200 times greater. As stated above, the amount of energy stored in typical corona ignition systems 20 is not enough to initiate and maintain arc discharge once an arc discharge occurs.

In one embodiment, as shown in FIGS. 1-4, the corona ignition system 20 includes a supplemental power supply, referred to as an energy power supply 68, providing the extra energy to the energy capacitor 62. Alternatively, the energy supplied to the energy circuit 28 may be from the same supply as the corona drive circuit 26. In another embodiment, the extra energy is transmitted from the corona drive circuit 26 to the energy circuit 28.

Upon receiving the arc control signal 60 from the energy controller 58, the energy circuit 28 transmits or discharges some or all of the storage energy, which is ultimately transmitted to the electrode 30. Thus, upon detection of the arc discharge, the stored energy supply is immediately depleted. Once the stored energy is discharged, the energy circuit 28 is immediately reset and supplemental energy is again supplied to the energy circuit 28. Accordingly, the system 20 is again ready to discharge stored energy to the electrode 30 upon the next occurrence of arc discharge and receipt of the arc control signal 60.

As shown in FIGS. 1-4, the corona ignition system 20 can transmit the stored energy to the electrode 30 according to several different paths, for example paths A, B, and C. The energy initially discharged from the energy circuit 28 is typically at a few hundred volts, which may not be great enough to initiate or maintain the arc discharge. Thus, the system 20 may include another transformer, referred to as an energy transformer 70, to increase the voltage of the energy prior to transmitting it to the electrode 30. The energy transformer 70 includes at least one coil of metal, referred to as a second coil 72, electrically connected to the energy circuit 28 and electrically connected to at least one other component of the system 20, either the LC circuit 48 or the electrode 30.

Figure 2:
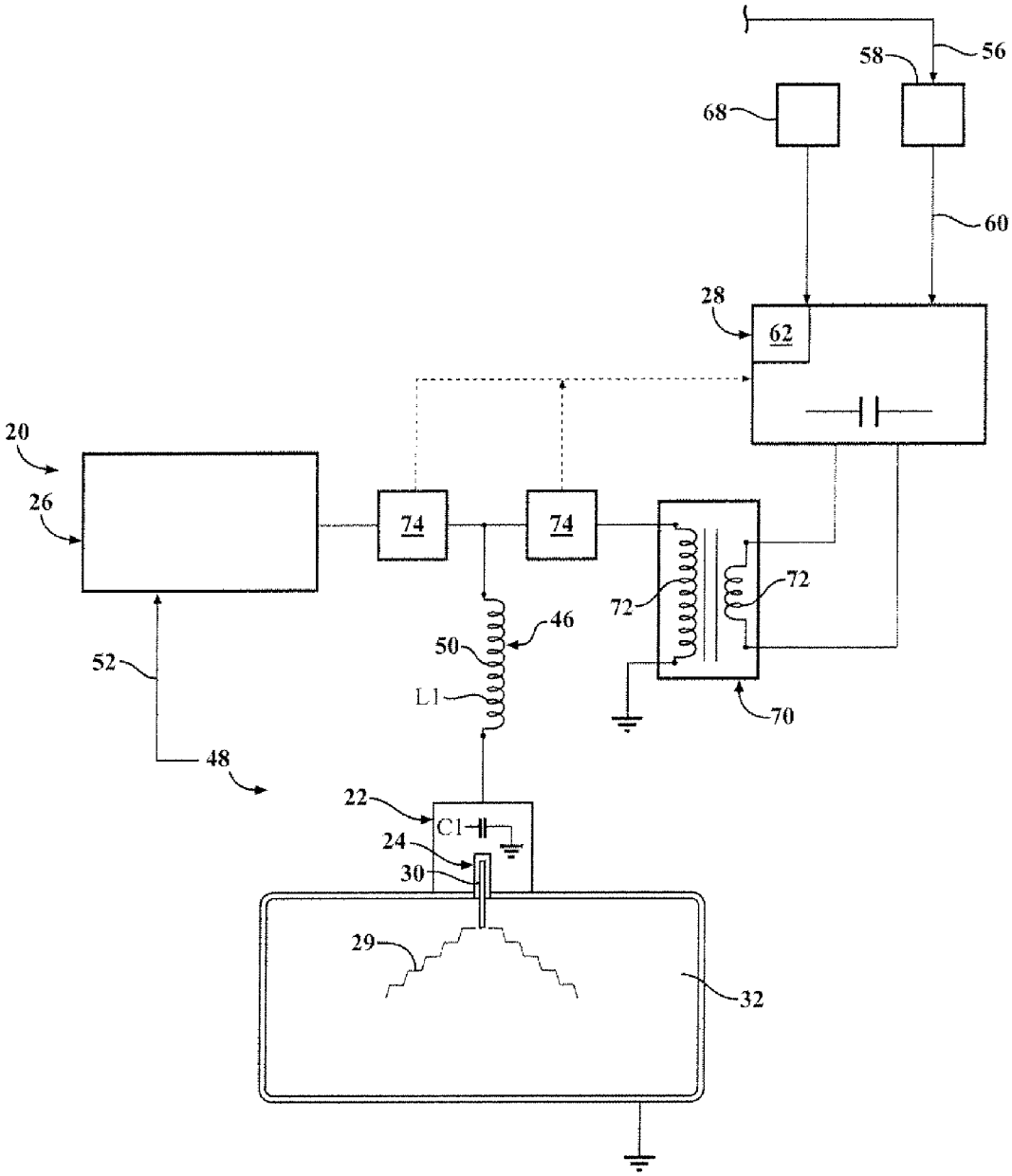
FIG. 2 is a diagram of the system of FIG. 1 showing energy delivery path A.
Figure 3:
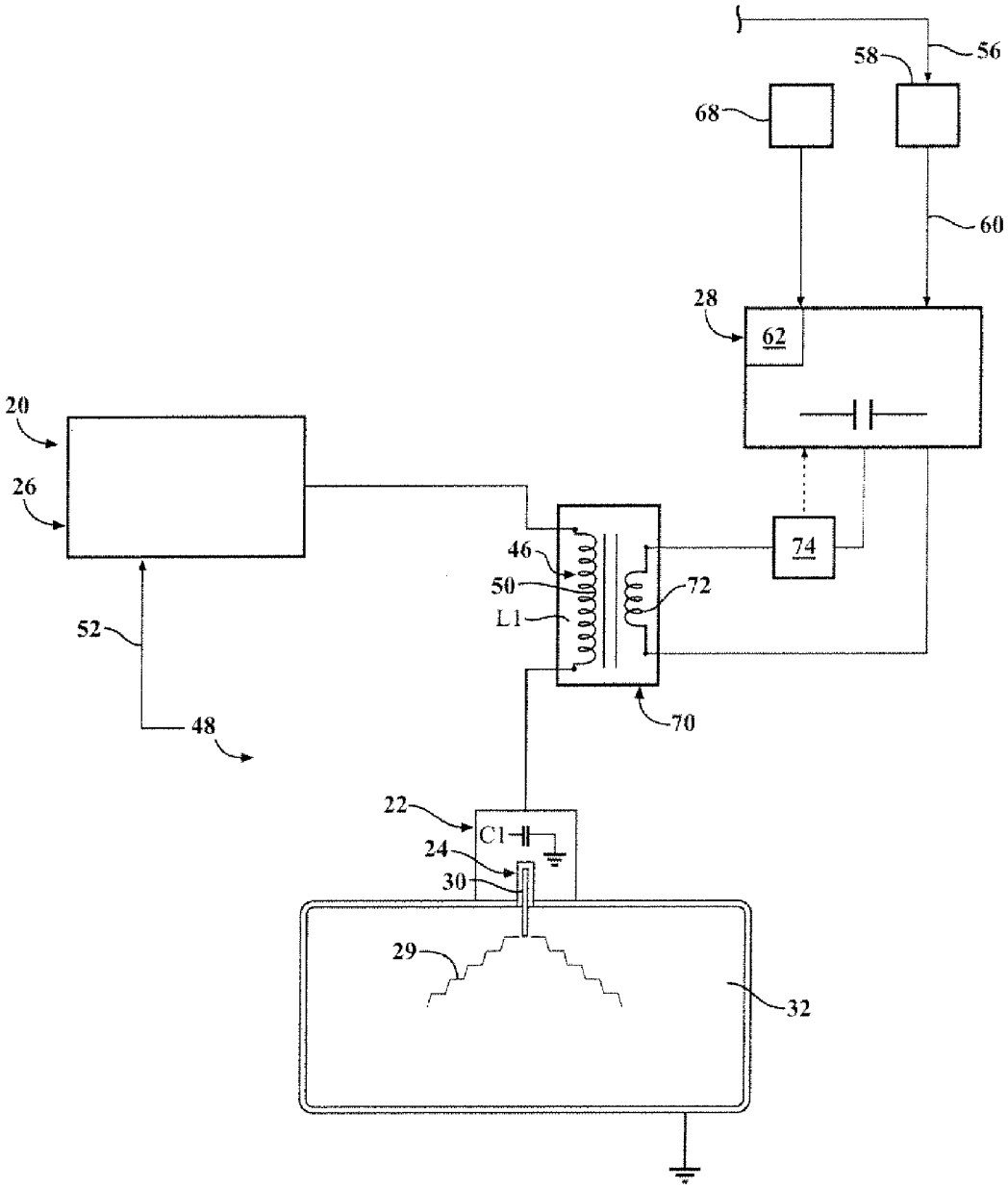
FIG. 3 is a diagram of the system of FIG. 1 showing energy delivery path B.
Figure 4:
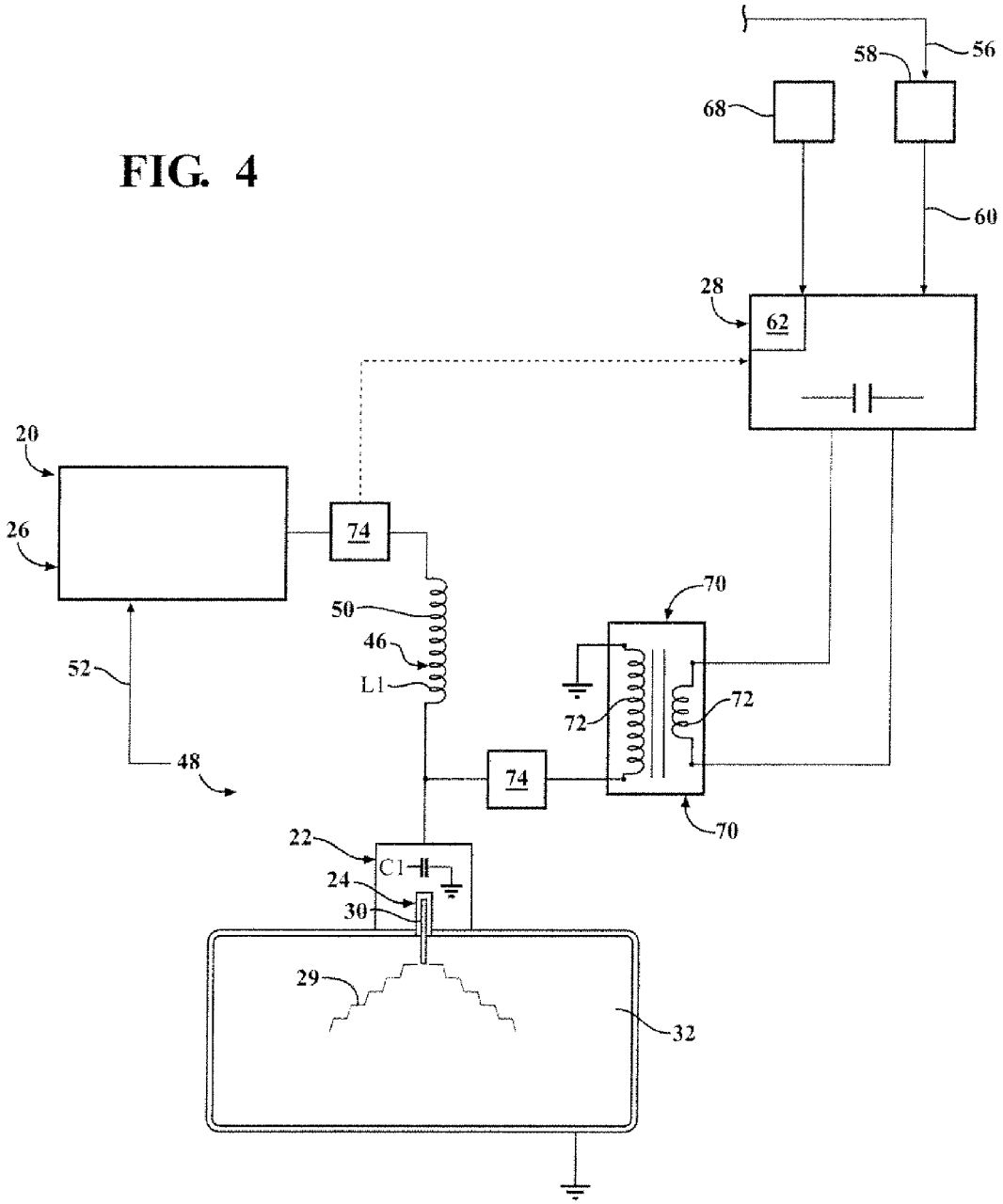
FIG. 4 is a diagram of the system of FIG. 1 showing energy delivery path C.

In the embodiments of FIGS. 2-4, the energy transformer 70 receives the stored energy from the energy circuit 28 and increases the voltage of the energy before transmitting it ultimately to the electrode 30. The energy transformer 70 may also be used to block energy from transmitting between the electrode 30 and the energy circuit 28 and to prevent damage to the circuits 26, 28, 48. In another embodiment, the energy transformer 70 is integrated with the drive transformer 44 of the corona drive circuit 26. In another embodiment, the energy transformer 70 is integrated with the resonating inductor 46 of the LC circuit 48. In yet another embodiment, a very high voltage is stored in the energy capacitor 62 of the energy circuit 28, and thus the energy transformer 70 is not necessary.

According to one embodiment, in order to maintain a robust arc discharge 29 capable of ensuring ignition, the stored energy is discharged from the energy circuit 28 and transmitted to the electrode 30 over a predetermined period of time, rather than discharged instantaneously. In one embodiment, the predetermined period of time, referred to as a time constant is approximately one millisecond. The time constant can be quantified by comparing it to the voltage (L1) of the resonating inductor 46 and the capacitance (C1) of the firing end assembly 22. The time constant must be longer than L1/C1, typically 100 to 2000 times longer. The energy circuit 28, energy transformer 70, and LC circuit 48, are programmed to meet the predetermined time constant.

To achieve the predetermined time constant and obtain the robust arc discharge 29, at least one blocking element 74, may be used to block energy from transmitting to and from or between the electrode 30, the corona drive circuit 26, the energy circuit 28, and other components of the system 20 during predetermined periods of time. The blocking elements 74 may also be designed to promote energy transmission between components of the system 20. In one embodiment, the blocking elements 74 are passive, for example a filter consisting of resistive and reactive components. In another embodiment, the blocking elements 74 include linear passive elements, for example diodes, TVS, or spark gap units. In yet another embodiment, the blocking elements 74 are fully active, for example a transistor. In yet another embodiment, wherein energy is supplied to the energy circuit 28 by the corona drive circuit 26, the blocking elements 74 are used to transmit energy from the corona drive circuit 26 to the energy capacitor 62. The design of the blocking elements 74 and their implementation depends on the specific requirements of the corona ignition system 20 and application of the system 20.

FIG. 2 illustrates one exemplary embodiment, wherein the energy circuit 28 transmits the stored energy along path A to the electrode 30. According to this embodiment, the energy transformer 70 is disposed between the energy circuit 28 and the resonating inductor 46 of the LC circuit 48. The stored energy is transmitted from the energy circuit 28 through the energy transformer 70, then through the resonating inductor 46 of the LC circuit 48 and finally to the electrode 30. The energy transformer 70 increases the voltage of the stored energy, prior to transmitting the stored energy to the LC circuit 48. The embodiment of FIG. 2 also includes one of the blocking elements 74 between the energy transformer 70 and the LC circuit 48 and another one of the blocking elements 74 between the LC circuit 48 and the corona drive circuit 26 to prevent energy from transmitting between the electrode 30 and the corona drive circuit 26 or the energy circuit 28. The energy circuit 28, energy transformer 70, and blocking elements 74 are programmed to deliver the stored energy according to the time constant to achieve the robust arc discharge 29.

FIG. 3 illustrates another exemplary embodiment, wherein the energy circuit 28 transmits the stored energy along path B to the electrode 30 and the energy transformer 70 is integral with the LC circuit 48. This exemplary embodiment is often preferred over the embodiments of FIGS. 2 and 4 for its simpler construction and thus lower cost. The integrated energy transformer 70 is formed by magnetically coupling the first coil 50 of the resonating inductor 46 with a second coil 72. A few turns of the second coil 72 are wound onto the same magnetic core as the first coil 50 of the resonating inductor 46, but the second coil 72 is electrically isolated from the first coil 50. The stored energy is transmitted from the energy circuit 28 through the integrated energy transformer 70 and LC circuit 48 and finally to the electrode 30. The integrated energy transformer 70 increases the voltage of the stored energy, prior to transmitting the stored energy to the electrode 30. The embodiment of FIG. 3 also includes one blocking element 74 between the integrated energy transformer 70 and the LC circuit 48. This blocking element 74 may prevent the energy circuit 28 from "bleeding" energy from the electrode 30, such as energy from the corona discharge when arc discharge has not yet occurred. Alternatively, the blocking element 74 may transmit any bled energy back to the energy capacitor 62 of the energy circuit 28. The energy circuit 28, transformer, and blocking elements 74 are programmed to deliver the stored energy according to the time constant and over the predetermine period to achieve the robust arc discharge.

FIG. 4 illustrates another exemplary embodiment, wherein the energy circuit 28 transmits the stored energy along path C to the electrode 30. According to this embodiment, the energy transformer 70 is auxiliary to the resonating inductor 46 of the LC circuit 48 and is disposed between the energy circuit 28 and the electrode 30. In this embodiment, the energy is transmitted from the energy circuit 28 directly to the electrode 30, and does not pass through the LC circuit 48.

The embodiment of FIG. 4 also includes one blocking element 74 between the energy transformer 70 and the LC circuit 48 to prevent energy from transmitting from the electrode 30 to back to the circuits 26, 28, 48, such as from the corona discharge, before arc discharge has occurred. Another one of the blocking elements 74 is located between the corona drive circuit 26 and the LC circuit 48 to prevent energy from transmitting from the electrode 30 back to the corona drive circuit 26 and to allow energy transmission through the LC circuit 48. The energy circuit 28, energy transformer 70, and blocking elements 74 are programmed to deliver the stored energy over the predetermine period of time to achieve the robust arc discharge.

Another aspect of the invention provides a method for igniting a mixture of fuel and air of an combustion chamber.

As alluded to above, the method includes supplying energy and drive control signals 38 to the corona drive circuit 26 while also supplying energy to the energy circuit 28. The method then includes transmitting energy from the corona drive circuit 26 to the electrode 30 in an amount capable of emitting the electrical discharge from the electrode 30. In one embodiment, the step of transmitting energy from the corona drive circuit 26 to the electrode 30 includes determining and transmitting a predetermine amount of energy, wherein the predetermined amount of energy is capable of emitting a corona discharge and avoiding an arc discharge.

While the energy is transmitting from the corona drive circuit 26 to the electrode 30, the method includes supplying and storing energy in the energy circuit 28 auxiliary to the corona drive circuit 26. The step of storing energy in the energy circuit 28 typically includes charging the energy capacitor 62 of the energy circuit 28. In one embodiment, the storing energy step includes transmitting energy from the corona drive circuit 26 to the energy circuit 28.

The method also includes detecting an arc discharge emitting from the electrode 30. Once the onset of arc discharge is detected, the method includes transmitting the arc feedback signal 56 to the energy controller 58, and then transmitting the arc control signal 60 from the energy controller 58 to the energy circuit 28. The arc control signal 60 initiates the step of transmitting or discharging the stored energy from the energy circuit 28 to the electrode 30 and thus intentionally maintaining an arc discharge 29.

As soon as sufficient stored energy is discharged and transmitted to the electrode 30, the method includes recharging the energy capacitor 62 of the energy circuit 28. The method includes maintaining energy in the energy circuit 28 in a sufficient amount, which is an amount capable of intentionally maintaining an arc discharge 29. Thus, the system 20 is immediately ready for the next occurrence of arc discharge.

As stated above, to maintain the robust arc discharge 29, the method includes transmitting the stored energy to the electrode 30 according to the time constant, over a predetermined period of time. In one embodiment, the method includes calculating the predetermined period of time, or time constant, and conveying the time constant to the energy circuit 28 in the arc control signal 60. The method typically includes increasing the voltage of the stored energy by the energy transformer 70, prior to transmitting the stored energy to the electrode 30. In one embodiment, the method includes using the blocking elements 74 for preventing or allowing energy from transmitting to and from or between the electrode 30, the corona drive circuit 26, the energy circuit 28, or other components of the system 20 during predetermined periods of time, such as while transmitting the stored energy from the energy circuit 28 to the electrode 30.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

ELEMENT LIST

| Element Symbol | Element Name |
|---|---|
| 20 | system |
| 22 | firing end assembly |
| 24 | igniter |
| 26 | corona drive circuit |
| 28 | energy circuit |
| 29 | corona or arc discharge |
| 30 | electrode |
| 32 | combustion chamber |
| 34 | drive power supply |
| 36 | drive circuit controller |
| 38 | drive control signal |
| 44 | drive transformer |
| 46 | resonating inductor |
| 48 | LC circuit |
| 50 | first coil |
| 52 | feedback loop signal |
| 56 | arc feedback signal |
| 58 | energy controller |
| 60 | arc control signal |
| 62 | energy capacitor |
| 68 | energy power supply |
| 70 | energy transformer |
| 72 | second coil |
| 74 | blocking element |

What is claimed is:

1. A corona ignition system (20) for igniting a mixture of fuel and air of a combustion chamber (32), comprising: an electrode (30), a corona drive circuit (26) transmitting energy to said electrode (30) in an amount capable of emitting an electrical discharge from said electrode (30), and an energy circuit (28) auxiliary to said corona drive circuit (26) for storing energy while said corona drive circuit (26) transmits said energy to said electrode (30) and transmitting said stored energy to said electrode (30) to intentionally maintain said arc discharge (29) upon detecting said arc discharge.

2. The system (20) of claim 1 including an energy controller (58) receiving an arc feedback signal (56) and transmitting an arc control signal (60) to said energy circuit (28) upon detection of said arc discharge, wherein said arc control signal (60) initiates transmitting said stored energy to said electrode (30).

3. The system (20) of claim 1 wherein said energy circuit (28) includes an energy capacitor (62) for storing said energy.

4. The system (20) of claim 1 further comprising a firing end assembly (22) having a capacitance and including said electrode.

5. The system (20) of claim 4 further comprising an LC circuit including a resonating inductor and said capacitance of said firing end assembly (22) for transforming said energy prior to transmitting said energy to said electrode (30).

6. The system (20) of claim 4 including an energy transformer (70) electrically connected to said energy circuit (28) and said resonating inductor (46) of said LC circuit (48) for increasing the voltage of said stored energy.

7. The system (20) of claim 6 wherein said energy transformer (70) is disposed between said energy circuit (28) and said resonating inductor (46) of said LC circuit (48) for transmitting said stored energy through said resonating inductor (46).

8. The system (20) of claim 6 wherein said energy transformer (70) is integral with said resonating inductor (46) of said LC circuit (48).

9. The system (20) of claim 6 wherein said energy transformer (70) is auxiliary to said resonating inductor (46) of said LC circuit (48) for transmitting said stored energy directly to said electrode (30).

10. The system (20) of claim 1 including a blocking element (74) preventing energy from transmitting between said electrode (30) and at least one of said corona drive circuit (26) and said energy circuit (28) during predetermined periods of time.

11. A method for igniting a mixture of fuel and air of a combustion chamber (32), comprising the steps of: transmitting energy from a corona drive circuit (26) to an electrode (30) in an amount capable of emitting an electrical discharge from the electrode (30), storing energy in an energy circuit (28) auxiliary to the corona drive circuit (26) while providing the energy to the electrode (30), detecting an arc discharge emitting from the electrode (30), intentionally maintaining arc discharge (29) upon detecting the arc discharge, and said intentionally maintaining arc discharge (29) step including transmitting the stored energy from the energy circuit (28) to the electrode (30).

12. The method of claim 11 including transmitting an arc control signal (60) to the energy circuit (28) to initiate said transmitting the stored energy step upon detecting the arc discharge.

13. The method of claim 12 including transmitting an arc feedback signal to initiate said transmitting the arc control signal (60) step upon detecting the arc discharge.

14. The method of claim 11 including maintaining energy in the energy circuit (28) in an amount capable of maintaining an arc discharge (29).

15. The method of claim 11 wherein said storing energy step includes charging an energy capacitor (62) of the energy circuit (28).

16. The method of claim 15 including recharging the energy capacitor (62) of the energy circuit (28) upon transmitting the stored energy from the energy circuit (28) to the electrode (30).

17. The method of claim 11 including transmitting the stored energy to the electrode (30) over a predetermined period of time.

18. The method of claim 11 including increasing a voltage of the stored energy prior to transmitting the stored energy to the electrode (30).

19. The method of claim 11 wherein said storing energy step includes transmitting energy from the corona drive circuit (26) to the energy circuit (28).

20. The method of claim 11 including preventing energy from transmitting between the electrode (30) and at least one of the corona drive circuit (26) and the energy circuit (28) during predetermined periods of time.

* * * * *